US005247867A

United States Patent [19]

Corney

[11] Patent Number: 5,247,867

[45] Date of Patent: Sep. 28, 1993

[54] TARGET TAILORING OF DEFENSIVE AUTOMATIC GUN SYSTEM MUZZLE VELOCITY

[75] Inventor: Martin Corney, Glendora, Calif.

[73] Assignee: Hughes Missile Systems Company, Los Angeles, Calif.

[21] Appl. No.: 821,659

[22] Filed: Jan. 16, 1992

[51] Int. Cl.[5] ..... F41B 6/00; F41G 3/06; F41G 9/00

[52] U.S. Cl. ..... 89/8; 89/41.03; 89/41.22; 235/415; 364/423

[58] Field of Search ..... 89/7, 8, 41.03, 41.22; 124/3; 235/415; 364/423

[56] References Cited

U.S. PATENT DOCUMENTS

| | | | |
|---|---|---|---|
| 2,998,598 | 8/1961 | Braun et al. | 343/7 |
| 3,056,336 | 10/1962 | Tailer | 89/8 |
| 3,293,643 | 12/1966 | Blomqvist | 343/7.4 |
| 3,431,816 | 3/1969 | Dale | 89/8 |
| 3,780,657 | 12/1973 | Zaid | 102/444 |
| 3,807,274 | 4/1974 | Cohen | 89/8 |
| 3,916,761 | 11/1975 | Fletcher et al. | 89/8 |
| 4,148,245 | 4/1979 | Steffanus et al. | 89/7 |
| 4,502,649 | 3/1985 | Botwin et al. | 244/3.1 |
| 4,640,180 | 3/1987 | Rose | 89/8 |
| 4,655,411 | 4/1987 | Franzen et al. | 244/3.11 |
| 4,712,181 | 12/1987 | Dahlberg | 89/41.22 |
| 4,729,319 | 3/1988 | Orlando | 102/351 |
| 4,836,083 | 6/1989 | Triezenberg | 89/8 |
| 5,081,901 | 1/1992 | Kemeny et al. | 89/8 |
| 5,138,929 | 8/1992 | Weldon et al. | 89/8 |

OTHER PUBLICATIONS

Farrar et al., Military Ballistics, 1983, pp. 5-6, 137-143, 161-163.

Webster's New World Dictionary of the American Language, "Gun", 1957, p. 646.

FMC, "Combustion Augmented Plasma (CAP TM) Gun System", Aug. 21, 1990, 4 pages.

The Electro-Magnetic Gun—Closer to Weapon-System Status, Military Technology (May 1988) pp. 80, 81, 83, 85 and 86.

Electrothermal Guns, National Defense (Sep. 1990), pp. 20-23.

*Primary Examiner*—Stephen C. Bentley

*Attorney, Agent, or Firm*—Charles D. Brown; Randall M. Heald; Wanda K. Denson-Low

[57] ABSTRACT

A velocity tailoring system for a defensive automatic gun having controllable muzzle velocity capability. The system includes velocity determination and control apparatus for determining the projectile discharge velocity necessary to achieve an effective target impact velocity that is less than a predetermined projectile shatter velocity. The projectile discharge velocity control signal is provided to the defensive automatic gun system.

28 Claims, 2 Drawing Sheets

TARGET TAILORING OF DEFENSIVE AUTOMATIC GUN SYSTEM MUZZLE VELOCITY

FIELD OF THE INVENTION

This invention relates to weapons, and more particularly, to defensive automatic gun systems for tracking and neutralizing an incoming airborne target.

BACKGROUND OF THE INVENTION

In gun firing close-in weapon systems, used for ship protection, for example, the target is typically a small, hard to defeat, oncoming missile whose closing velocity is vectorially added to that of the defending projectile. As oncoming missile velocities increase, the projectile approaches a limiting velocity known as the shatter velocity where solid penetrator type defending projectiles essentially fail at target impact. In such instances, actual intercept contact is made, but minimal damage results because the projectile shatters rather than penetrating for optimum impact and damage because of the high combined target impact velocity. To maintain the energy levels for energy transfer with deep the impact velocity should be reduced to below the shatter velocity. Until now, there has been no system for continuously controlling projectile impact velocity so as not to exceed a predetermined shatter velocity in a defensive gun firing weapon system. This is especially true for high fire rate gun systems.

SUMMARY OF THE INVENTION

It is an object of the present invention to provide a velocity tailoring system for a defensive automatic gun wherein the combined projectile/target impact velocity is maintained at an effective level that is less than a predetermined shatter velocity.

It is a further object of the invention to provide a velocity tailoring system for a defensive automatic gun wherein target destruction is enhanced.

Among the problems to be solved by the invention is creating an optimal, or near optimal, combined impact velocity of the projectile and the target. If that combined target impact velocity is too slow, there is insufficient energy involved to achieve significant penetration. If the combined velocity is too fast, the projectile tends to shatter without useful penetration and the resulting desired effective damage. The material and characteristics of the target are only partially important. The shatter characteristics of the defensive projectiles are known and are constants. The most important factor to be determined in each instance is target closing velocity. A significant aspect of the invention involves determining that velocity.

In accordance with the foregoing objectives, the velocity tailoring system for a defensive automatic gun includes a system for determining the projectile discharge or muzzle velocity necessary to achieve an effective target impact velocity that is less than a predetermined shatter velocity. The system includes sensors to determine target range and closing velocity. Computations are made to determine the gun muzzle velocity required so that the combined projectile and target velocities at impact are below the projectile shatter velocity. A projectile discharge velocity control signal is then provided to the defensive automatic gun system to modify the gun muzzle velocity as required for desired impact velocity.

In an alternative embodiment the system of the invention is capable of dual or plural modes of attack, where different impact velocities are calculated and achieved. One may be at or above the projectile shatter velocity for specific purposes and another may be below the shatter velocity for depth destruction. Other projectile velocity combinations and reasons therefor may be achieved.

The gun involved is contemplated as being a high fire rate gun (at least 200 rounds per minute) having a continuously controllable muzzle velocity. Electrothermal gun systems are examples of one acceptable type of gun.

BRIEF DESCRIPTION OF THE DRAWING

The objects, advantages and features of this invention will be more readily appreciated when read in conjunction with the accompanying drawing, in which.

DESCRIPTION OF THE PREFERRED EMBODIMENTS

Figure 1:
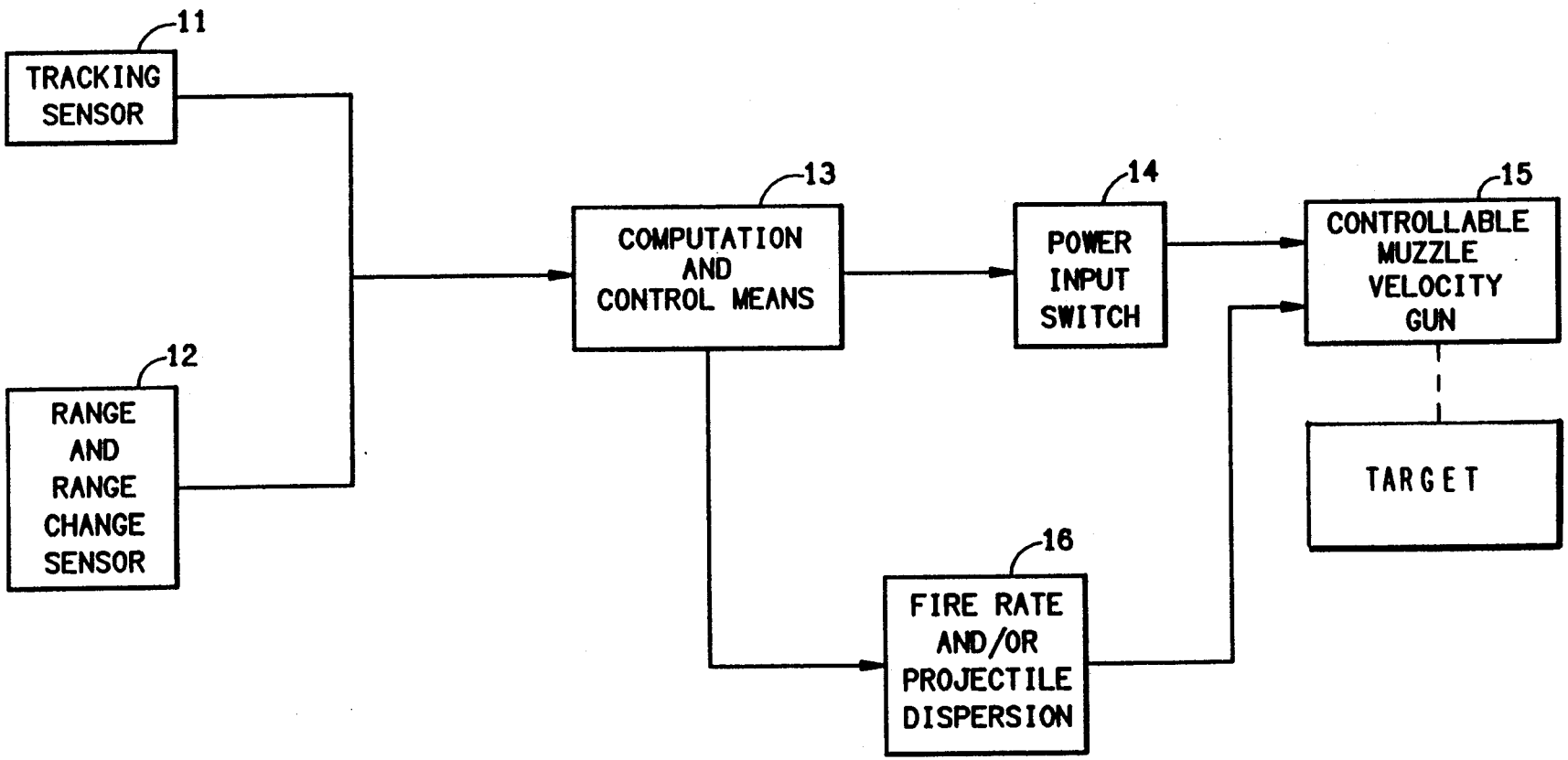
FIG. 1 is a block diagram of the major functional elements of the present invention.

A velocity tailoring close-in weapon system constructed in accordance with this invention operates to track a target and determine its closing range and velocity in order to calculate the muzzle velocity required to discharge a projectile in order to achieve target intercept at an effective combined target impact velocity (representing a combination of target and projectile velocity components) that is normally less than a predetermined shatter velocity. The muzzle velocity tailoring is done, for example, by adjusting the electrical energy input provided to an electrothermal gun system capable of changing muzzle velocity to match the effective impact velocity requirements. Other types of controllable muzzle or terminal velocity guns or projectile launchers may be used. One example is a liquid propellant gun. Because the system is intended to be employed with a high fire rate gun having continuously controllable muzzle velocity, electrothermal gun systems are preferred.

Examples of controllable muzzle velocity projectile launchers are described in U.S. Pat. Nos. 4,640,180; 4,729,319 and 4,836,083. Electrothermal gun systems are also discussed in two published articles, The Electro-Magnetic Gun -- Closer to Weapon-System Status, Military Technology (May 1988), pp. 80, 81, 83, 85 and 86, and Electrothermal Guns, National Defense (September 1990), pp. 20–23.

In general, electrothermal gun technology involves using electrical energy acting on a working fluid to create a plasma behind a projectile. The plasma has the advantage, over conventional powder propellants, of having a lower molecular weight and hence a higher speed of sound capability, similar to the effects produced in light gas guns. Proper choice of the working fluid allows additional energy to be imparted to the projectile by adding a chemical energy input to the electrical energy input. This combination can yield extremely high efficiencies. Muzzle energy can be amplified by many times the electrical energy input required to create the plasma. Muzzle velocity of such a gun is modified by modifying the electrical energy input to the gun.

As shown in the drawing, the weapon system of this invention includes tracking sensor 11, such a doppler radar, laser, IR, thermal imager, for example, which acquires and tracks the target. At an appropriate time after a target has been acquired, the target range and closing velocity relative to the gun may be obtained using doppler radar, laser ranging or other known systems 12. These basically sense range and successive readings give range change rate, from which the closing velocity vector can easily be calculated. With the gun target range and velocity known, the optimum intercept velocity of the projectile can be calculated, of course, taking into consideration normal velocity losses due to aerodynamic drag and any other factors which occur between the gun muzzle and the target. Calculations are preferably performed by high speed computer operating in real time, referred to as computation and control means 13.

An optimum projectile discharge velocity is determined by the computation and control means 13. If the standard gun velocity power level would result in an intercept velocity which is too high, that is, in excess of the predetermined shatter velocity of the projectile, a corresponding reduction in the gun power input is made by generating instructions from control means 13 as a signal output to control power input switch 14, thus lowering the muzzle (and combined intercept) velocities. Conversely, if the desired intercept velocity is higher than could be achieved by firing a standard round the gun power input can be increased by means of a signal output from computer 13 to switch 14, which then modifies the electrical energy input to the gun. If the determined projectile muzzle velocity is equal to the standard muzzle velocity or the existing muzzle velocity setting, no change in the gun power input level to controllable muzzle velocity gun 15 is made.

To achieve a high probability of kill ($P_k$), instructions may be generated to adjust fire rate, burst length (the number of rounds fired per group) and even dispersion within a group, as shown in the drawing as an optional capability in fire rate and/or projectile dispersion modifier 16. These adjustments may be made when projectile velocity and time of flight are changed.

Figure 2:
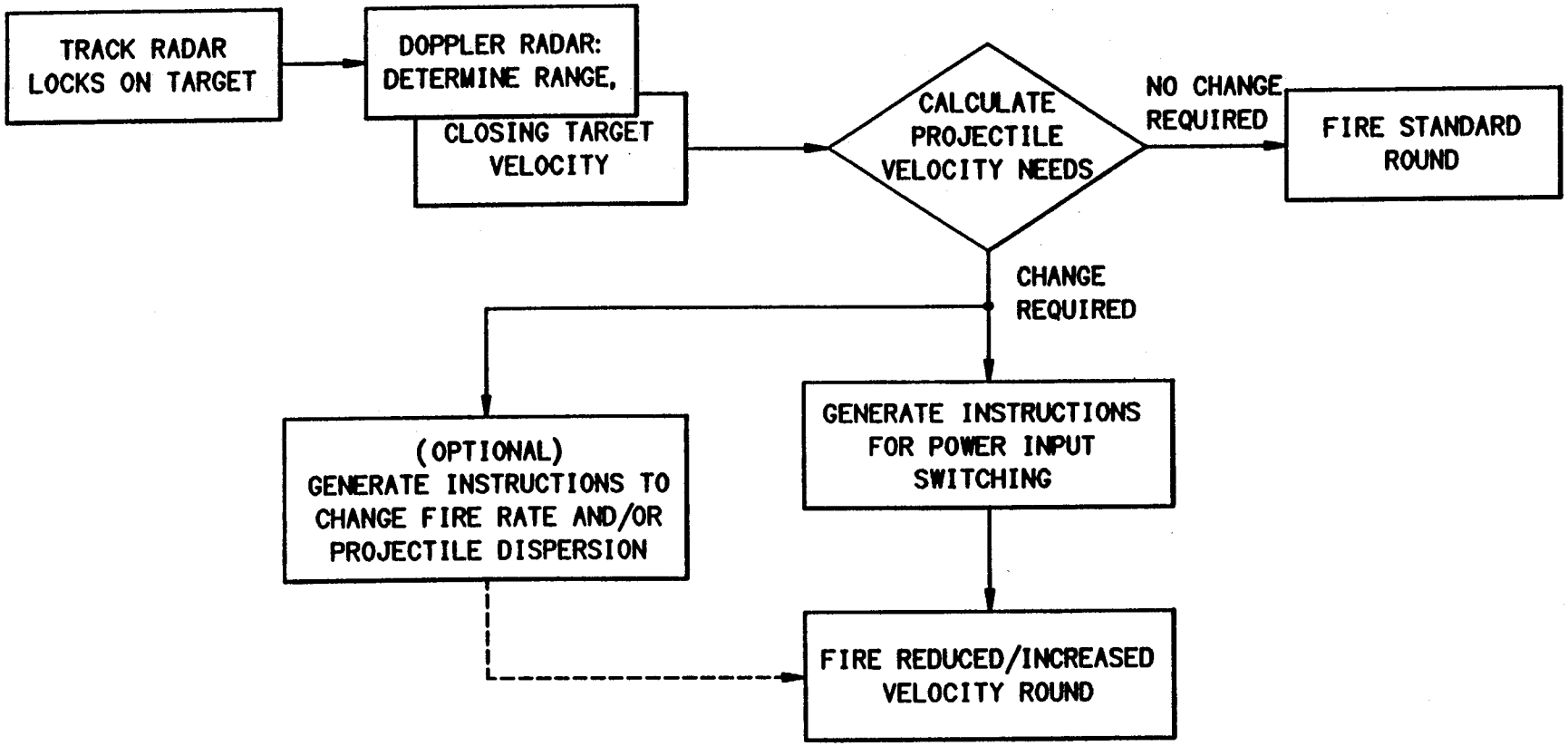
FIG. 2 is a flow chart of a velocity tailoring system constructed in accordance with the invention showing the functional characteristics of the system.

The system block diagram of FIG. 1 is represented in the flow chart of FIG. 2.

The above discussion concerns method and apparatus to ensure that the vectorially combined projectile and target velocities do not exceed projectile shatter velocity. However, there may be circumstances where projectiles of different velocities may be employed against the same target. For example, it may be desired for the first projectiles to exceed shatter velocity in order to cause greater surface damage. This shallow damage may have substantial value, including removal of significant parts of the target such as forebody parts of a missile. Subsequent projectiles will be fired at somewhat reduced muzzle velocity to avoid projectile shatter and result in deeper penetration into and greater damage to the remaining target structure. A variable muzzle velocity gun, with the control system as employed in the system of this invention is easily capable of such dual or plural modes of attack.

It should be noted that if the sensors employed to locate and track the target can make a positive identification of the target by type or model, or both, this may permit a further refinement to the desired impact velocity at the target. Similarly, another useful bit of information possibly available to refine the inputs to the gun would be the projectile angle of impact with the target. To reiterate, these sensors can be of any system capable of target location and tracking, such as radar, acoustic, IR and laser, among others.

Accordingly, a novel velocity tailoring system for the muzzle velocity of a defensive automatic gun has been disclosed. While various aspects and embodiments have been shown and described, it should be understood that modifications and adaptations thereof will likely occur to persons skilled in the art. Therefore, the protection afforded the invention should not be limited except in accordance with the spirit and scope of the following claims and their equivalents.

What is claimed is:

1. In an electrothermal defensive automatic gun system for tracking and destroying an incoming airborne target, the gun system having controllable muzzle velocity capability and having a standard muzzle velocity for launching projectiles having a known predetermined shatter velocity on impact with the target, an improved method for tailoring the gun system muzzle velocity, by which the launched projectile intercepts the target, to an optimum intercept velocity required for maximum target damages, a method comprising the steps of:

tracking an incoming airborne target;

determining the target range and closing velocity with respect to the gun system;

calculating a projectile muzzle velocity based on the determined target range and closing velocity necessary to achieve a maximum effective impact velocity with the target said maximum effective impact velocity being less than the predetermined projectile shatter velocity; and maintaining the standard muzzle velocity setting if equal to the calculated projectile muzzle velocity and, if the standard muzzle velocity setting is not equal to the determined projectile muzzle velocity, adjusting the muzzle velocity setting to equal the determined projectile muzzle velocity.

2. A velocity tailoring system for a defensive automatic gun system having controllable muzzle velocity capability, said velocity tailoring system comprising:

velocity determining means for using range and velocity of a target for determining a projectile discharge velocity necessary to achieve an effective combined target impact velocity that is less than a predetermined projectile shatter velocity, said effective combined target impact velocity being determined by vectorially adding the target velocity and the projectile discharge velocity, less normal velocity losses occurring in flight between the gun muzzle and the target; and signal output means from said velocity determining means for providing a projectile muzzle velocity control signal to the defensive automatic gun system having controllable muzzle velocity capability.

3. A method for tailoring projectile discharge velocity in a defensive automatic gun system, the gun system having controllable muzzle velocity capability, the method comprising the steps of:

determining, using range and velocity of a target, a projectile discharge velocity necessary to achieve an effective target impact velocity that is less than a predetermined projectile shatter velocity, said effective target impact velocity being determined by vectorially adding the target velocity and the projectile discharge velocity, less the velocity losses normally occurring between the gun muzzle and the target; and providing a projectile discharge velocity control signal to the gun system as necessary to control the projectile discharge velocity of the gun system.

4. A projectile velocity tailoring system for a defensive automatic gun system including a gun, the gun system having controllable muzzle velocity capability by which the launched projectile intercepts a target, the projectile having a known predetermined shatter velocity on impact with the target, said velocity tailoring system comprising:

means for determining range to the target and target closing velocity, both relative to the gun;

computation and control means containing data on projectile shatter velocity characteristics, said computation and control means receiving target range and closing velocity data, said computation and control means determining the desired projectile discharge velocity necessary to achieve effective combined projectile/target impact velocity having a desired relationship to the predetermined projectile shatter velocity, the output of said computation and control means being a signal representing the desired projectile discharge velocity; and means for applying said output signal to said controllable muzzle velocity gun so that a projectile fired from said gun will impact the target at a combined effective projectile/target impact velocity having the desired relationship to the shatter velocity of the projectile.

5. The system set forth in claim 4, and further comprising means for providing a fire rate modifying control signal to said defensive automatic gun system.

6. The system set forth in claim 4, and further comprising means for providing a projectile dispersion control signal to said defensive automatic gun system.

7. The system set forth in claim 4, wherein the defensive automatic gun system is an electrothermal gun.

8. The system set forth in claim 4, wherein said velocity determining means include a digital information processing system.

9. The system set forth in claim 4, wherein said velocity determining means include a high speed computer operating in real time.

10. The system set forth in claim 4, and further including means for determining the effective combined target impact velocity by vectorially adding the target velocity and the projectile discharge velocity, less normal velocity losses occurring in flight between the gun muzzle and the target.

11. The system set forth in claim 4, and further comprising means for providing a fire rate modifying control signal to said defensive automatic gun system.

12. The system set forth in claim 4, wherein a first predetermined combined projectile/target impact velocity is less than a predetermined projectile shatter velocity.

13. The system set forth in claim 12, wherein a second predetermined combined projectile/target impact velocity at least equals the predetermined projectile shatter velocity so that said output signal is selected form said first and second predetermined combined impact velocities for each projectile fired from said gun system.

14. A projectile velocity tailoring system for a defensive automatic gun system including a gun, the gun system having controllable muzzle velocity capability by which the launched projectile intercepts a target, the projectile having a known predetermined shatter velocity on impact with the target, said velocity tailoring system comprising:

means for determining range to the target and target closing velocity, both relative to the gun;

computation and control means containing data on projectile shatter velocity characteristics, said computation and control means receiving target range and closing velocity data, said computation and control means determining the desired projectile discharge velocity necessary to achieve effective combined projectile/target impact velocity which is less than the predetermined projectile shatter velocity, the output of said computation and control means being a signal representing the desired projectile discharge velocity; and means for applying said output signal to said controllable muzzle velocity gun so that a projectile fired form said gun will impact the target at a combined effective projectile/target velocity less than said shatter velocity of the projectile.

15. A method for tailoring projectile discharge velocity in a defensive automatic gun system including computation and control means and a gun, the gun system having controllable muzzle velocity capability by which the launched projectile intercepts a target, the projectile having a known predetermined shatter velocity on impact with the target, the method comprising the steps of:

determining the range of the target and the target closing velocity with respect to the gun;

entering data regarding projectile shatter velocity characteristics in the computation and control means;

entering the target range and closing velocity data in the computation and control means;

determining the desired projectile discharge velocity necessary to achieve effective combined projectile/target impact velocity which velocity has a desired relationship to the predetermined projectile shatter velocity;

generating an output signal form the computation and control means representing the desired projectile discharge velocity;

applying the output signal to the gun system so that a projectile fired form the gun will impact the target at a combined effective projectile/target impact velocity having the desired relationship to the shatter velocity of the projectile.

16. The method set forth in claim 15, and comprising the further step of providing a fire rate control signal to the defensive automatic gun system.

17. The method set forth in claim 15, and comprising the further step of controlling the projectile discharge velocity and projectile dispersion of a defensive automatic gun system as necessary to achieve an effective target impact velocity and projectile dispersion.

18. The method set forth in claim 15, wherein a first effective target impact velocity is a first predetermined velocity less than a predetermined projectile shatter velocity.

19. The method set forth in claim 18, wherein a second effective target impact velocity at least equal the predetermined projectile shatter velocity so that the projectile muzzle velocity control signal is selected from the first and second predetermined target impact velocities for each projectile fired from the gun system.

20. A method for tailoring projectile discharge velocity in a defensive automatic gun system including computation and control means and a gun, the gun system having controllable muzzle velocity capability by which the launched projectile intercepts a target, the projectile having a known predetermined shatter velocity on impact with the target, the method comprising the steps of:

determining the range of the target and the target closing velocity with respect to the gun;

entering data regarding projectile shatter velocity characteristics in the computation and control means;

entering the target range and closing velocity data in the computation and control means;

determining the desired projectile discharge velocity necessary to achieve effective combined projectile/target impact velocity which is less than the predetermined projectile shatter velocity;

generating an output signal form the computation and control means representing the desired projectile discharge velocity;

applying the output signal to the gun system so that a projectile fired form the gun will impact the target at a combined effective projectile/target impact velocity less than the shatter velocity of the projectile.

21. The method set forth in claim 20, and comprising the further step of providing a fire rate control signal to the defensive automatic gun system.

22. The method set forth in claim 20, and comprising the further step of providing a projectile dispersion control signal to the defensive automatic gun system.

23. The method set forth in claim 20, and comprising the further step of controlling the projectile discharge velocity and fire rate of a defensive automatic gun system as necessary to achieve an effective target impact velocity and fire rate.

24. The method set forth in claim 20, and comprising the further step of controlling the projectile discharge velocity and projectile dispersion of a defensive automatic gun system as necessary to achieve an effective target impact velocity and projectile dispersion.

25. The method set forth in claim 20, wherein the defensive automatic gun system is an electrothermal gun.

26. The method set forth in claim 20, wherein said velocity determining step utilizes a digital information processing system.

27. The method set forth in claim 20, wherein said velocity determining step utilizes a high speed computer operating in real time.

28. The method set forth in claim 20, wherein the effective target impact velocity is determined by vectorially adding the target velocity and the projectile discharge velocity, less the velocity losses normally occurring between the gun muzzle and the target.

* * * * *